United States Patent [19]

Imamura et al.

[11] 4,175,051

[45] Nov. 20, 1979

[54] SCOURING PAD CONTAINING PHOSPHORIC ACID ESTER-FATTY ACID SOAP MIXTURES

[75] Inventors: Tetsuya Imamura; Takashi Hiraide, both of Tokyo; Haruhiko Arai, Narashino; Megumu Hirakura, Matsudo, all of Japan

[73] Assignee: Kao Soap Co., Ltd., Tokyo, Japan

[21] Appl. No.: 872,659

[22] Filed: Jan. 26, 1978

[30] Foreign Application Priority Data

Feb. 25, 1977 [JP] Japan ..... 52-20112

[51] Int. Cl.[2] ..... C11D 9/34; C11D 9/46; C11D 17/00

[52] U.S. Cl. ..... 252/91; 15/104.93; 252/108; 252/109; 252/117; 252/526; 252/545; 252/DIG. 17

[58] Field of Search ..... 252/91, 92, 108, 109, 252/DIG. 17, 526, 545; 15/104.93

[56] References Cited

U.S. PATENT DOCUMENTS

| | | | |
|---|---|---|---|
| 2,765,279 | 10/1956 | Nüsselein | 252/117 |
| 2,896,242 | 7/1959 | Winch | 15/209 |
| 3,337,465 | 8/1967 | Lancz et al. | 252/91 |
| 3,585,144 | 6/1971 | Schlitz et al. | 252/91 |

FOREIGN PATENT DOCUMENTS

| | | | |
|---|---|---|---|
| 244316 | 11/1962 | Australia . | |
| 512956 | 5/1955 | Canada | 252/108 |

*Primary Examiner*—P. E. Willis, Jr.
*Attorney, Agent, or Firm*—Blanchard, Flynn, Thiel, Boutell & Tanis

[57] ABSTRACT

A scouring pad comprising a fine metal wire pad and a detergent adhered thereto, wherein the detergent comprises a salt of an ester of phosphoric acid having the formula (I):

$$[R(OCH_2CH_2)_m]_xPO_4H_{3-x-y}M_y \quad (I)$$

wherein R is alkyl or alkenyl having 10 to 22 carbon atoms or alkylphenyl having 6 to 18 carbon atoms in the alkyl group, wherein said alkyl or alkenyl can be linear or branched, m is from 0 to 10, x is from 1.0 to 2.0, and y is from 0.5 to 2.0, with the proviso that the sum of x and y does not exceed 3, and M is an alkali metal, ammonium, alkanolamine, alkaline earth metal, zinc or aluminum cation, and a fatty acid soap having 10 to 22 carbon atoms.

10 Claims, No Drawings

SCOURING PAD CONTAINING PHOSPHORIC ACID ESTER-FATTY ACID SOAP MIXTURES

BACKGROUND OF THE INVENTION

FIELD OF THE INVENTION

The present invention relates to a scouring pad. More particularly, the invention relates to a scouring pad composed of a steel wool-like mat made of fine metal threads and a detergent adhered thereto.

Stains on cooking pots and pans caused by overflowing, scorching and cooking of foods, stains on stoves and ovens, grease stains on ventilation fans and stains on tile joints are commonly observed in homes. They are conspicuous, undesirable and difficult to remove. Detergents comprising an alkali and a solvent, ammonia and caustic alkalis, brasive cleansers, pot cleaners and brushes composed of steel wool, nylon and metals, spatulas, knives and the like have heretofore been used for removing these stains. The chemical actions of detergents and the like are quite effective for removing stains formed by modification or polymerization of oils caused by heat, light or air, but they are not very effective for removing stains formed by scorching and carbonizing of overflowed soups, oils and the like. The physical actions of mechanical polishing materials such as polishing cleaners and brushes composed of nylon, steel wool and metals not only remove the stains but also abrade the underlying surface. Therefore, the surface of the pot, pan, tile or plastic article is damaged and scratched by the stain-removing operation. Accordingly, the appearance of the cleaned surface is degraded to a matte finish and the cleaned surface can easily be contaminated with stains again. In the case of a soap-filled steel wool pad or cleaner, the amount of scratching is reduced as compared with the results obtained using a soap-free brush or cleaner, but the scratch-preventing effect is still insufficient.

We have discovered a scouring pad capable of achieving the following objects:

(1) The scouring pad has a high washing power such that it can remove effectively oil stains, scorching stains, roasting stains and the like;

(2) The scouring pad does not damage the underlying material such as steel plate, aluminum sheet, stainless steel sheet, tile, plastic article or the like;

(3) The detergent contained in the steel wool pad is not easily removed therefrom and the scouring pad is highly durable.

We have found that the foregoing objects can be attained by employing a scouring pad comprising a spongy mat of fine metal threads and a detergent impregnated therein, wherein the detergent comprises a mixture of a salt of a phosphoric acid ester and a fatty acid soap.

The phosphoric acid ester salt that is used in the present invention has the following formula (I):

$$[R(OCH_2CH_2)_m]_xPO_4H_{3-x-y}M_y \quad (I)$$

wherein R is alkyl or alkenyl having 10 to 22 carbon atoms, preferably 12 to 18 carbon atoms, or alkylphenyl having 6 to 18 carbon atoms, preferably 8 to 14 carbon atoms, in the alkyl group, wherein said alkyls and alkenyl can be linear or branched, m is from 0 to 10, preferably from 0 to 5, x is from 1.0 to 2.0, y is from 0.5 to 2.0, with the proviso that the sum of x and y does not exceed 3, and M is an alkali metal such as sodium or potassium, ammonium, alkanolamine such as monoethanolamine, diethanolamine or triethanolamine, alkaline earth metal such as calcium or magnesium, zinc or aluminum cation.

The fatty acid soap that is used in the present invention includes salts of saturated or unsaturated fatty acids having 10 to 22 carbon atoms, preferably 12 to 18 carbon atoms, with alkali metals such as sodium and potassium, ammonia, alkanolamine such as monoethanolamine, diethanolamine and triethanolamine, alkaline earth metals such as calcium and magnesium or polyvalent metals such as aluminum. From the viewpoints of best adherence to the fine metal threads and water solubility, a sodium salt of coconut fatty acid or beef-tallow fatty acid is preferably employed.

The amount of the phosphoric acid ester salt in the detergent composition is from 2 to 50% by weight, preferably 5 to 40% by weight, especially preferably 10 to 30% by weight, and the amount of the fatty acid soap is from 40 to 98% by weight, preferably 50 to 95% by weight, especially preferably 60 to 85% by weight.

The weight ratio of the detergent composition to the metal thread mat is from 0.2/1 to 2.0/1, preferably 0.5/1 to 1.5/1.

The detergent can optionally contain other water-soluble surface active agents and water-soluble inorganic salts in addition to the above-mentioned phosphoric acid ester salt and fatty acid soap.

As the optional surface active agents, there can be used anionic surface active agents, nonionic surface active agents and amphoteric surface active agents. As the anionic surface active agent, there can be mentioned, for example, alkyl sulfate salts having 10 to 22 carbon atoms, alkylbenzenesulfonate salts having 8 to 16 carbon atoms in the alkyl group, polyoxyethylene alkyl ether sulfate salts having 10 to 20 carbon atoms in the alkyl group and in which the molar number of added ethylene oxide units is from 1 to 10, polyoxyethylene alkylphenyl sulfate salts having 8 to 12 carbon atoms in the alkyl group and in which the mole number of added ethylene oxide units is from 1 to 10, salts of α-olefin-sulfonic acids obtained by sulfonating an α-olefin having 10 to 18 carbon atoms, and salts of alkane-sulfonic acids obtained from paraffins having 10 to 20 carbon atoms. As the nonionic surface active agents, there can be mentioned, for example, polyoxyethylene alkyl ethers formed by adding 1 to 20 moles of ethylene oxide to higher alcohols having 10 to 20 carbon atoms, polyoxyethylene alkylphenyl ethers formed by adding 1 to 20 moles of ethylene oxide to alkylphenols having an alkyl of 8 to 12 carbon atoms, glycerin esters of fatty acids having 10 to 20 carbon atoms, and fatty acid alkanolamides derived from fatty acids having 10 to 20 carbon atoms and alkanolamines such as diethanolamine and isopropanolamine. As the amphoteric surface active agent, there can be mentioned, for example, alkyl betaines, alkyl sulfobetaines, imidazole derivatives and alkyl alanines.

As the inorganic salt, there can be used, for example, sulfates such as sodium sulfate and potassium sulfate, carbonates such as sodium carbonate and potassium carbonate, silicates such as sodium metasilicate and sodium silicate No. 2, borates such as borax and sodium metaborate, and phosphates such as sodium orthophosphate, sodium tripolyphosphate and sodium pyrophosphate. Alkali metal silicates and alkali metal phosphates (especially secondary phosphates) possess an excellent rust-preventing effect, and when these salts are incorporated in amounts of from 2 to 20% by weight, especially 5 to 12% by weight, in the detergent composition, scouring pads having especially good properties can be obtained. Further, anionic surface active agents have an effect of enhancing the washing power, and when they are incorporated in amounts of up to 10% by weight, preferably 2 to 7% by weight, in the detergent compositions, stains formed by carbonization of overflowed soups or oils can be effectively removed.

In addition, colorants, perfumes, fungicides and mildew-proofing agents can be incorporated in the detergents according to need.

When the thickness of the fine metal threads is too large, the surface to be treated is readily scratched and the tactile feel of the scouring pad is bad. If the thickness is too small, the polishing power is reduced. Accordingly, it is preferred that the diameter of the fine metal threads is from 1 to 500μ, especially 10 to 70μ. The cross-sectional shape of the fine metal threads that are used in the present invention is not critical, and fine metal threads having a triangular, square, circular or flat cross-section can be used in the present invention. Further, the material of which the fine metal threads are made is not critical, and any metals having a sufficient tensile strength to be formed in fine threads, such as plain carbon steel, stainless steel and brass, can be used. Plain carbon steel is especially preferred because it possesses an excellent polishing power and touch to the hand. A spongy metal thread mat having a circular, square, rectangular, oblong or elliptical shape (and having a sufficient thickness irrespective of its planar shape) can be used in the present invention.

The scouring pad of the present invention can be prepared by shaping the fine metal threads into an appropriate form, sprinkling thereon an aqueous solution of the detergent composition and heating the detergent-containing metal wire mat under pressure to dry same. Of course, the scouring pad of the present invention can be prepared according to other methods.

The present invention will now be described in more detail by reference to the following illustrative Examples that do not limit the scope of the invention.

EXAMPLE 1

Stains were removed by using mats of fine metal threads having a surface active agent, as indicated below, impregnated therein. The polishing power and the lubricating effect on an aluminum material were examined. The results shown in Table 1 were obtained. The polishing power and lubricating effect were determined by the following methods.

Measurement of Polishing Power

A paint was used as a specimen stain. The paint was coated and dried on an aluminum saucer having a thickness of 1 mm and a diameter of 7 cm. Then, 5 g of a 20% aqueous solution containing a surface active agent as indicated below was filled in the saucer, and a disc-like mat (having a weight of 3 g, a diameter of 5 cm and a thickness of 1.5 cm) of a steel wire (having an average diameter of 20 to 50μ) was pressed on the saucer under a load of 2 Kg and was rotated for 2 minutes by a laboratory motor whereby to scrub the saucer. The effect of polishing away the specimen stain was determined based on the difference between the weight of the saucer before the scrubbing and the weight of the saucer after the scrubbing. In Table 1, the polish amount is a relative value calculated on the basis that the amount of the change of the weight of the saucer attained by the use of only water (no surface active agent) as a polishing agent, is assigned the arbitrary value of 100.

The polish amount for aluminum was determined by conducting the above test by using an aluminum saucer which was not coated with the paint.

Measurement of Lubricating Property

The same specimen stain and aluminum material as used for the measurement of the polish amount were employed. The lubricating property was measured by using a tachometer to measure the speed of rotation (rpm) of the mat during the above-described polishing step. The lubricating property is expressed in terms of a relative value of the speed of rotation (rpm) of the mat calculated on the basis that the speed of rotation measured when only water was used is assigned the arbitrary value of 100.

Thus, in the following table, a polishing amount of over 100 shows that the surface active agent was more effective than plain water for removing the specimen stain. In like fashion, a lubricating property of over 100 shows that the surface active agent has a higher lubricating property than plain water.

Table 1

Polishing Power and Lubricating Property of Various Surface Active Agents to Stain and Aluminum

| | Stain | | Aluminum | |
|---|---|---|---|---|
| Surface Active Agent | Polish Amount | Lubricating Property | Polish Amount | Lubricating Property |
| disodium salt of monoester of phosphoric acid with coconut alcohol | 96 | 161 | 0 | 132 |
| monopotassium stearyl sesquiphosphate | 93 | 188 | 0 | 135 |
| monoammonium beef-tallow alcohol diphosphate | 98 | 183 | 0 | 136 |
| disodium decyl monophosphate | 90 | 143 | 0 | 122 |
| 1.5Na salt of polyoxyethylene (added mole number = 2) palmityl sesquiphosphate | 121 | 159 | 0 | 144 |
| monosodium polyoxyethylene (added mole number = 10) lauryl sesquiphosphate | 110 | 163 | 2 | 121 |
| 1.5Na salt of polyoxyethylene (added mole number = 15) lauryl sesquiphosphate | 105 | 172 | 5 | 117 |
| 1.5Na salt of oxo-alcohol (carbon number = 12.5) sesquiphosphate | 109 | 181 | 0 | 138 |
| monosodium dodecylphenyl diphosphate | 115 | 158 | 0 | 135 |
| monosodium polyoxyethylene (added mole number = 3) nonylphenyl sesquiphosphate | 108 | 167 | 0 | 139 |
| sodium salt of coconut fatty acid | 87 | 184 | 15 | 125 |
| sodium dodecylbenzene-sulfonate | 130 | 135 | 30 | 100 |
| sodium dodecyl sulfate | 110 | 139 | 24 | 109 |

Table 1-continued

Polishing Power and Lubricating Property of Various Surface Active Agents to Stain and Aluminum

| Surface Active Agent | Stain | | Aluminum | |
|---|---|---|---|---|
| | Polish Amount | Lubricating Property | Polish Amount | Lubricating Property |
| polyoxyethylene (added mole number = 8) lauryl ether | 100 | 134 | 123 | 82 |
| sodium secondary phosphate | 90 | 113 | 57 | 98 |
| sodium metasilicate | 117 | 126 | 65 | 102 |

From the results shown in Table 1, it will be apparent that various phosphoric acid ester salts have a higher polishing power to stains and a lower polishing power to aluminum and have a higher lubricating effect to stains and aluminum than other surface active agents.

EXAMPLE 2

A disc-like mat having a diameter of 5 cm and a thickness of 1.5 cm was formed from 5 g of a fine steel wire having an average diameter of 20 to 50μ, and 15 g of a 60% aqueous solution of an adherent detergent having the composition indicated below was applied to the mat. The mat was then heated under pressure to impregnate the adhering detergent composition into the interior of the mat. Then, the mat was dried to remove water whereby a scouring pad was obtained.

Sodium stearyl sesquiphosphate—20 wt. %
Sodium salt of coconut fatty acid—70 wt. %
Sodium secondary phosphate—10 wt. %

EXAMPLE 3

In the same manner as described in Example 2, scouring pads having applied thereto detergent compositions as set forth in Table 2, were prepared. The polishing power and lubricating property to stains and aluminum were measured. The results shown in Table 2 were obtained.

Table 2

(all % values are weight percent)

| | 1(present invention) | 2(present invention) | 3(present invention) | 4(present invention) | 5(present invention) |
|---|---|---|---|---|---|
| Composition of Applied Detergent | sodium stearyl sesquiphosphate, 20% | monosodium oxo-alcohol ($C_{12.5}$) sesquiphosphate, 10% | sodium polyoxyethylene (added mole number = 2) palmityl sesquiphosphate, 20% | sodium poly oxyethylene (added mole number = 2) stearyl sesquiphosphate, 45% | diethanolamine dodecyl monophosphate, 5% |
| | sodium salt of coconut fatty acid, 70% | sodium salt of beef-tallow fatty acid, 80% | sodium palmitate, 70% | sodium salt of beef-tallow fatty acid, 50% | sodium salt of coconut fatty acid, 85% |
| | sodium secondary phosphate, 10% | sodium dodecyl benzenesulfonate, 5% | sodium secondary phosphate, 10% | sodium silicate No. 2, 5% | sodium dodecyl benzenesulfonate, 5% |
| | — | sodium silicate No. 2, 5% | — | — | sodium secondary phosphate, 5% |
| Appearance, etc. | good | good | good | good | good |
| Stain | | | | | |
| polish amount | 131 | 155 | 153 | 152 | 138 |
| lubricating effect | 188 | 189 | 190 | 192 | 178 |
| Aluminum | | | | | |
| polish amount | 0 | 0 | 0 | 0 | 0 |
| lubricating effect | 149 | 148 | 145 | 156 | 140 |

| | 6(present invention) | 7 (comparison) | 8 (comparison) | 9 (comparison) | 10 (comparison) |
|---|---|---|---|---|---|
| Composition of Applied Detergent | potassium polyoxyethylene (added mole number = 3) nonylphenyl sesquiphosphage, 15% | | | | |
| | sodium salt of coconut fatty acid, 70% | commercially available product A | sodium stearyl sesquiphosphate, 100% | sodium salt of coconut fatty acid, 100% | sodium dodecyl benzenesulfonate, 100% |
| | sodium α-olefin-sulfonate, 5% | | | | |
| | sodium secondary | | | | |

Table 2-continued (all % values are weight percent)

| | phosphate, 10% | | | | |
|---|---|---|---|---|---|
| Appearance, etc. | good | good | detergent was not adhered in good state | good | detergent was sticky and not dried |
| Stain polish amount | 149 | 110 | 93 | 87 | 130 |
| lubricating effect | 181 | 152 | 188 | 184 | 135 |
| Aluminum polish amount | 0 | 25 | 0 | 15 | 30 |
| lubricating effect | 145 | 117 | 132 | 125 | 100 |

As will be apparent from the results shown in Table 2, when the phosphoric acid ester salt and soap were used in combination, the stain-polishing power is synergistically improved in comparison with the polishing power attained by the use of the ester salt or soap alone. Further, the aluminum surface is not substantially polished, and the lubricating effect to the stain surface or aluminum surface is high and the stain can be removed by a light rubbing force. Furthermore, the product of the present invention has higher stain-polishing power and lubricating effect than the commercially available product A. The commercially available product has a very high polishing power to aluminum and readily damages aluminum materials.

EXAMPLE 4

Stained articles were polished for 1 minute by applying the same force, using sample No. 2 of Example 3 and the commercially available product A. The removal of stains and scratching of the material were examined. The results obtained are shown in Table 3.

Table 3

| | Gas Range Saucer | | Pail (polypropylene) | | Peripheral Portion of Gas Range (Stainless steel) | | Frying Pan (iron) | |
|---|---|---|---|---|---|---|---|---|
| | removal of stains | scratch | removal of stains | scratch | removal of stains | scratch | removal of stains | scratch |
| Sample No. 2 (Example 3) | O | O | O | O | O | O | O | O |
| Commercially Available Product A (Comparison) | Δ | Δ | O | X | Δ | X | Δ | Δ |

Note removal of stains:
O : well removed
Δ : moderately removed
X : not removed
scratch:
O : not scratched
Δ : slightly scratched
X : considerably scratched

EXAMPLE 5

The synergistic effects attained by the phosphoric acid ester salt and soaps in the present invention are shown in Table 4. As the phosphoric acid ester salt, a 1.5 Na salt of dodecyl monophosphate was used, and a sodium salt of beef-tallow fatty acid was used as the soap. A composition comprising a mixture of 90% of the phosphoric acid ester salt and soap and 10% of sodium silicate No. 2 was used. The scouring pads were prepared in the same manner as described in Example 2. The properties thereof were determined in the same manner as described in Example 3.

Table 4

| Content (%) of 1.5Na salt of dodecyl monophosphate | Content (%) of sodium salt of beef-tallow fatty acid | Appearance, etc. | Stains | | Aluminum | |
|---|---|---|---|---|---|---|
| | | | polish amount | lubricating effect | polish amount | lubricating effect |
| 0 | 90 | good | 90 | 178 | 28 | 121 |
| 1 | 89 | good | 98 | 186 | 10 | 135 |
| 5 | 85 | good | 132 | 188 | 2 | 141 |
| 10 | 80 | good | 152 | 193 | 0 | 155 |
| 20 | 70 | good | 157 | 196 | 0 | 154 |
| 40 | 50 | good, applied detergent slightly dislodged | 130 | 195 | 0 | 156 |
| 60 | 30 | detergent did not adhere well | 115 | 195 | 0 | 156 |

As will be apparent from the results shown in Table 4, an especially high synergistic effect can be obtained when the phosphoric acid ester salt is incorporated in an amount of 5 to 40%, preferably 10 to 30%. When the amount of the phosphoric acid ester salt is too small, the stain-removing effect is reduced and aluminum is scratched. When the amount of the phosphoric acid ester salt is too large, adherence of the detergent is degraded and the applied detergent tends to fall out of the pad.

EXAMPLE 6

The influences of the amount of the detergent applied to a fine steel wire pad, on the polishing effect, are shown in Table 5. The detergent used comprised 20% of monosodium polyoxyethylene (mole number of added ethylene oxide=3) lauryl sesquiphosphate, 70% of a sodium salt of beef-tallow fatty acid and 10% of sodium secondary phosphate. The amount of the detergent impregnated in the pad was changed as indicated in Table 5. Scouring pads were prepared in the same manner as described in Example 2, and properties thereof were determined in the same manner as described in Example 3.

Table 5

| Weight Ratio of Applied Detergent to Fine Steel Wire | Appearance, etc. | Stains polish amount | Stains lubricating effect | Aluminum polish amount | Aluminum lubricating effect |
|---|---|---|---|---|---|
| 0 | readily rusting and deformed | 100 | 100 | 100 | 100 |
| 0.2 | good, relatively more rust as compared with pads having larger amounts of applied detergent | 132 | 186 | 3 | 139 |
| 0.5 | good | 148 | 187 | 0 | 152 |
| 1.0 | good | 159 | 191 | 0 | 158 |
| 2.0 | good | 147 | 194 | 0 | 165 |
| 2.3 | applied detergent fell out in small masses | 123 | 198 | 0 | 173 |

As will be apparent from the results shown in Table 5, when the amount of the applied detergent is small, the stain-removing effect is relatively low and the aluminum substrate is slightly scratched. Further, the steel wire tends to rust. If the amount of the applied detergent is too large, the stain-removing effect is degraded and the applied detergent readily falls out. Accordingly, good results are not obtained.

EXAMPLE 7

A disc-like mat was prepared from 20 g of brass wire having a rectangular cross-section of $20\mu \times 400\mu$, and 20 g of a 60% aqueous solution of a detergent having the composition indicated below was applied to the mat and heated under pressure so that the applied detergent was impregnated into the interior of the mat. Then, water was removed from the mat by drying to obtain a scouring pad.

1.5 Na salt of beef-tallow alcohol sesquiphosphate—20%
Sodium salt of beef-tallow fatty acid—80%

EXAMPLE 8

A disc-like mat was prepared from 28 g of a fine stainless steel wire having a rectangular cross-section of $20\mu \times 200\mu$, and 25 g of a 60% aqueous solution of a detergent having the composition indicated below was applied to the mat and heated under pressure so that the applied detergent was impregnated into the interior of the mat. Then, water was removed from the mat by drying to obtain a scouring pad.

Monosodium salt of beef-tallow alcohol sesquiphosphate—10%
Sodium salt of hardened beef-tallow fatty acid—90%

The scouring pads prepared in Examples 7 and 8 were used for actual removal of stains. The results shown in Table 6 were obtained. For comparison, the results obtained with respect to comparative pads having no detergent applied thereto are shown in Table 6. From the results shown in Table 6, it will readily be understood that if no detergent is applied, the material is readily scratched.

Table 6

| Pad | Stainless steel sink removal of stains | Stainless steel sink scratch | Aluminum cooking pot removal of stains | Aluminum cooking pot scratch |
|---|---|---|---|---|
| Example 7 | O | O | O | O |
| Comparison (pad of Example 7 with no applied detergent) | O | X | O | X |
| Example 8 | O | O | O | O |
| Comparison (pad of Example 8 with no applied detergent) | O | X | Δ | x |

Note
Removal of Stains:
O : well removed
Δ : moderately removed
X : not removed
Scratch:
O : not scratched
Δ : slightly scratched
X : considerably scratched The embodiments of the invention in which an exclusive property or priviliege is claimed are defined as follows:

1. A scouring pad comprising a spongy, fine metal thread pad and a detergent composition impregnated therein, said detergent composition consisting essentially of from 5 to 40 percent by weight of one or a mixture of phosphoric acid ester salts having the formula (I):

$$[R(OCH_2CH_2)_m]_xPO_4H_{3-x-y}M_y \quad (I)$$

wherein R is alkyl or alkenyl having 10 to 22 carbon atoms or alkylphenyl having 6 to 18 carbon atoms in the alkyl group, wherein said alkyls or alkenyl can be linear or branched, m is from 0 to 10, x is from 1.0 to 2.0, y is from 0.5 to 2.0 with the proviso that the sum of x and y does not exceed 3, and M is an alkali metal, ammonium, alkanolamine, alkaline earth metal, zinc or aluminum cation, and from 50 to 95 percent by weight of fatty acid soap having 10 to 22 carbon atoms, the weight ratio of said detergent composition to said fine metal thread pad being from 0.2/1 to 2.0/1.

2. A scouring pad as set forth in claim 1 wherein R is alkyl or alkenyl having 12 to 18 carbon atoms or an alkylphenyl group having 8 to 14 carbon atoms in the latter alkyl, m is from 0 to 5, and M is a member-selected from the group consisting of sodium, potassium, ammonium, monoethanolamine, diethanolamine and triethanolamine.

3. A scouring pad as set forth in claim 1 wherein the fine metal threads are made of plain carbon steel and have an average diameter of 10 to 70μ.

4. A scouring pad as set forth in claim 1 in which the weight ratio of said detergent composition to said pad is from 0.5/1 to 1.5/1.

5. A scouring pad as set forth in claim 4 in which said detergent composition contains from 10 to 30% by weight of said phosphoric acid ester salt and from 60 to 85% by weight of said soap.

6. A scouring pad as set forth in claim 4 in which the sum of said phosphoric acid ester salt and said soap is at least 70% by weight of the total weight of said detergent composition and said detergent composition contains from 0 to 30% by weight of water-soluble, non-soap anionic, nonionic or amphoteric surfactants different from said phosphoric acid ester salt, or water-soluble inorganic salts or mixtures thereof.

7. A scouring pad as set forth in claim 5 in which said detergent composition contains from 2 to 20% by weight of alkali metal silicates, alkali metal phosphates or mixtures thereof.

8. A scouring pad as set forth in claim 5 in which said detergent composition consists of from 5 to 12% by weight of alkali metal silicate, alkali metal phosphate or mixture thereof, and the balance is said fatty acid soap and said phosphoric acid ester salt.

9. A scouring pad as set forth in claim 5 in which said detergent composition consists of from 2 to 7 percent by weight of said water-soluble non-soap synthetic anionic surfactant, and the balance is said fatty acid soap and said phosphoric acid ester salt.

10. A scouring pad as set forth in claim 5 in which said detergent composition consists of from 5 to 12 percent by weight of alkali metal phosphate, alkali metal silicate or mixture thereof, from 2 to 7 percent by weight of said water-soluble non-soap synthetic anionic surfactant, and the balance is said fatty acid soap and said phosphoric acid ester salt.

* * * * *